United States Patent [19]

Hein, Jr.

[11] 4,360,149

[45] Nov. 23, 1982

[54] CENTRIFUGE ROTOR WITH LIQUID SUPPORTED SWINGING TUBES

[76] Inventor: George N. Hein, Jr., 331 Chesham Ave., San Carlos, Calif. 94070

[21] Appl. No.: 205,363

[22] Filed: Nov. 10, 1980

[51] Int. Cl.[3] ..... B04B 9/12

[52] U.S. Cl. ..... 233/26; 233/27

[58] Field of Search ..... 233/26, 27, 23 A, 1 C, 233/1 R, 1 A, 11, 14 R

[56] References Cited

U.S. PATENT DOCUMENTS

| | | | |
|---|---|---|---|
| 2,053,185 | 9/1936 | Flowers | 233/26 |
| 3,248,046 | 4/1966 | Feltman | 233/26 |
| 3,851,817 | 12/1974 | Buck | 233/26 |
| 3,921,898 | 11/1975 | Finkel | 233/23 A |
| 3,997,105 | 12/1976 | Hayden | 233/26 |

*Primary Examiner*—Robert W. Jenkins

*Attorney, Agent, or Firm*—R. J. Steinmeyer; F. L. Mehlhoff; William H. May

[57] ABSTRACT

A centrifuge rotor having an internal chamber in which are mounted a plurality of swinging centrifuge tubes containing fluid samples. Located within the rotor chamber is a liquid support medium which minimizes the amount of stress experienced on the centrifuge tube and at the pivotal junction of the tube with the rotor. The unique arrangement of having the buoyant force of a liquid within the rotor provides support to the tubes when the tubes have pivoted to their position during operational speed. The liquid support is designed to reorient in response to centrifugation in order to automatically provide the buoyant force to the tube during centrifugation and thereby reduce or greatly minimize the strength necessary in the mechanical design and construction of the support elements for the swinging tubes or containers.

7 Claims, 4 Drawing Figures

CENTRIFUGE ROTOR WITH LIQUID SUPPORTED SWINGING TUBES

BACKGROUND OF THE INVENTION

The present invention is directed to centrifuge rotors having swinging fluid sample containers or tubes and, more specifically, is directed to a rotor which utilizes a liquid support medium within the rotor to provide buoyant support to the swinging containers or tubes when the rotor is operating at very high speeds.

Various configurations of rotors utilizing swinging buckets or other types of containers are presently used in centrifuges. Typically, fluid samples are placed within centrifuge tubes which are supported within some type of container or bucket that is mounted on a metal support in the rotor. The container is mounted in such a way that it will pivot through an arc of approximately 90° between its position at rest and its position during operational speeds of the rotor. When the centrifuge tube is at rest, its longitudinal axis generally aligns itself in a somewhat parallel position with respect to the spin axis of the rotor. However, during high speed centrifugation, the swinging tube moves radially outward in response to centrifugally induced forces on the tube, so that the longitudinal axis of the tube is approximately perpendicular to the spin axis of the rotor.

It is important in centrifugation that motion of the fluid sample in the tube during rotor acceleration and deceleration is minimized. Interaction between particles and the tube wall should be minimized and the sedimentation of flotation particles should take place generally along the longitudinal axis of the tube. It has been found that a swinging tube type of centrifuge rotor has these desirable features and, therefore, is utilized in many centrifugation experiments as being the only successful or practical approach. This is true with respect to the example of the centrifugal separation of liquid protein components of human serum for scanning by light scattering.

One of the major concerns with respect to utilization of swinging tube type rotors is the fact that tremendous forces of thousands of kilograms are exerted not only on the tube, but also on the supporting heads and pivot junctions that are utilized in the pivoting design of the tube or the container holding the tube. During ultracentrifugation some rotors reach operational speeds of 150,000 rpm to 200,000 rpm. Therefore, the tube and overall supporting mechanism for the tube must be made of a very high strength material. In addition, the pivot junction is usually significantly large and is designed with great care.

SUMMARY OF THE INVENTION

The present invention is directed to a centrifuge rotor having an internal cavity or chamber which contains a plurality of pivotal containers or tubes. Also positioned within the rotor chamber is a liquid medium that is designed to provide buoyant force to the pivoting centrifuge tubes or containers, so that the stresses on the tubes and on the pivoting portions of the tubes or containers are greatly minimized. The interior of the rotor may be designed in such a manner that the supporting fluid medium may or may not provide support when the tube is in a vertical or at rest position, but will provide support when the tube attains its position at operational speeds. This is accomplished by the fact that the fluid medium is designed to automatically reorient in response to the centrifugally induced forces of the operation of the rotor, so that it will be positioned adjacent the centrifuge tube when it has also been reoriented to an operational position during the spinning of the rotor. The type and the amount of the liquid will determine the amount of buoyant support provided to the swinging tubes. Various liquids of different specific gravities could be utilized.

DETAILED DESCRIPTION OF THE INVENTION

Figure 1:
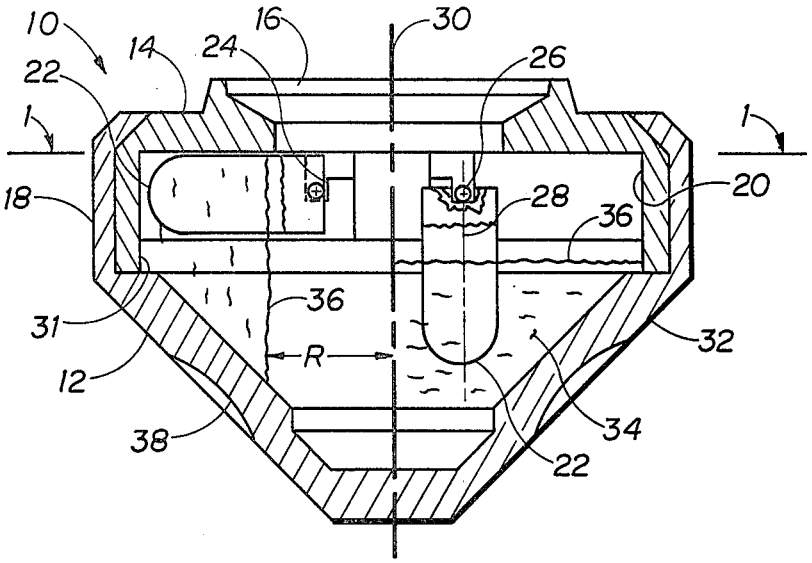
FIG. 1 is a vertical sectional view of a centrifuge rotor embodying the present invention.

Reference is made to FIG. 1 showing a rotor 10 having a lower body portion 12 and an upper body portion 14. Located in the upper portion 14 is an opening 16 which is designed to receive a flexible snap fitted cover (not shown). The opening 16 allows access into the interior of the rotor 10. The upper portion 14 of the rotor is press fitted into the upperward annular flange 18 of the lower portion 12 of the rotor. The upper portion 14 of the rotor is a partially solid member with a plurality of cavities 20 formed within it and designed to receive swinging centrifuge tubes or containers 22. Located in the upper portion 14 of the rotor is a central groove 24 in which rests lugs 26 projecting from each of the centrifuge tubes 22.

Figure 4:
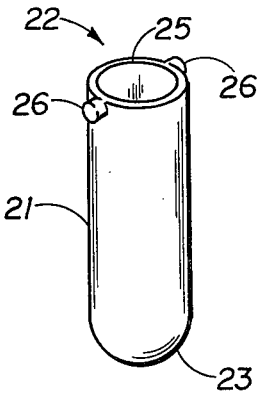
FIG. 4 is a perspective view of a swinging centrifuge tube used in the present invention.

As shown in FIG. 4, the centrifuge tubes 22 have an elongated central portion 21 with an enclosed bottom end and an open upper end 25. The tubes 22 are designed to be made in such a manner that the projecting lugs 26 located at the upper or open end 25 of the tubes 22 are integrally formed with the tube. The lugs 26 preferably have a cylindrical configuration and are designed to pivot within a groove 24 in FIG. 2 located in the upper portion of the rotor. Utilization of this uniquely designed centrifuge tube allows for an uncomplicated arrangement to accomplish the pivoting of the tube or container within the rotor. This ability to incorporate the use of lugs integrally formed on the centrifuge tube is enhanced by the utilization of the support medium such as water within the rotor to provide support to the tube during ultracentrifugation as will be discussed below.

With respect to FIG. 1, the right-hand portion of the figure represents the position of the centrifuge tube 22 when the rotor is at rest. The left-hand side of FIG. 1 shows the position of the centrifuge tube 22 when the rotor is at operational speed. Consequently, the longitudinal axis 28 of the tube 22 is essentially parallel with the spin axis 30 of the rotor when at rest and is essentially perpendicular to the spin axis 30 when the rotor is operating at speed.

Located within an internal chamber or reservoir 31 formed adjacent the bottom 32 of the rotor on the right-hand side of FIG. 1 is a liquid medium 34, such as water, which provides buoyant force to the centrifuge tube 22. When the rotor is spinning at operational speed, the liquid medium 34 will reorient itself to the orientation shown on the left-hand side of FIG. 1 in order to provide the buoyant force to the centrifuge tube 22 in its operational position. Consequently, the supporting liquid medium experiences approximately a 90° reorientation with respect to its surface 36 in response to centrifugally induced forces.

The closer the surface level 36 of the liquid support medium is to the spin axis 30 of the rotor during centrifugation, the greater the buoyant force on the centrifuge tube 22. The specific gravity or density of the liquid will also affect the amount of buoyancy exerted upon the tubes.

In some instances the interior of the rotor may be significantly large enough that, when the rotor is at rest, no liquid medium will support the swinging container, since the liquid medium may all accumulate at the bottom of the rotor. However, the rotor and the containers must be designed in such a manner that during centrifugation the liquid medium will support the containers.

Figure 2:
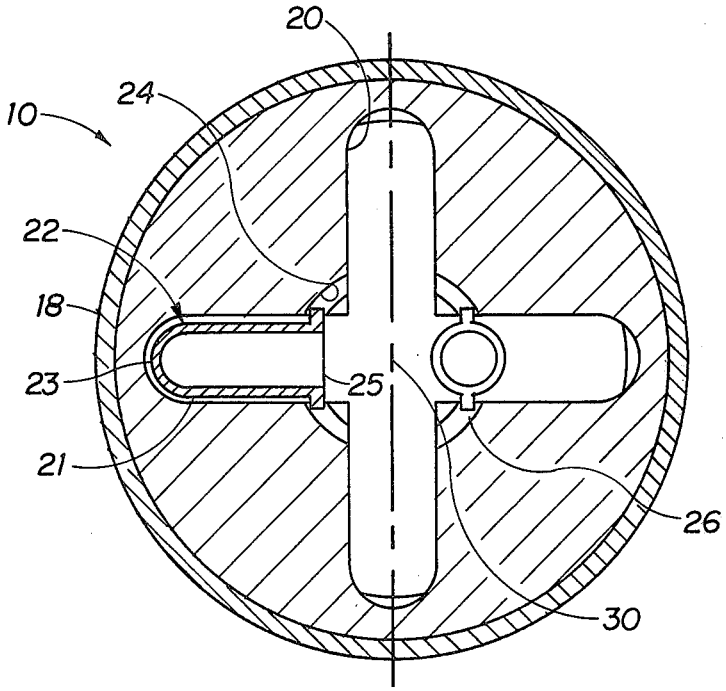
FIG. 2 is a sectional view taken along the lines 1—1 in FIG. 1.

The embodiment in FIGS. 1 and 2 shows an air driven rotor 10 with a plurality of flutes 38 designed to receive impinging driving jet air from a centrifuge rotor seat (not shown). However, the present invention is not envisioned to be limited to use solely with an air driven type of centrifuge rotor. It is envisioned that this particular arrangement can be utilized in any type of swinging container rotor. Further, the tubes shown in FIGS. 1 and 2 have integrally formed pivot pins on the upper portion of the tubes. Other designs and configurations can be utilized in order to provide the mechanism for a swinging container rotor. Also any balanced number of swinging containers could be used depending upon the size of the rotor.

Figure 3:
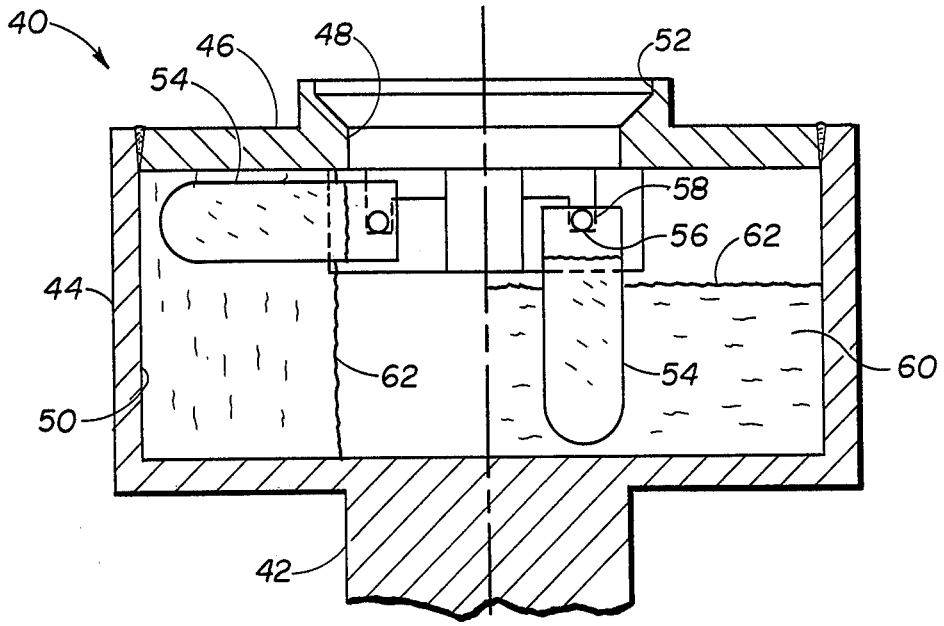
FIG. 3 is a vertical sectional view of an alternate embodiment of a centrifuge rotor incorporating the present invention.

Attention is directed to FIG. 3 showing a rotor 40 designed to be driven by a drive shaft 42. The rotor generally has a lower body portion 44 and an upper portion 46 having an opening 48 for access into the interior rotor 40. The grooved portion 52 in the opening 48 is designed to receive a snap fitted flexible cover (not shown). The centrifuge tubes 54 are designed in a similar manner as those shown in FIGS. 1 and 2 and have integrally formed pins 56 located at the upper portion of each of the tubes. An annular groove or channel 58 is formed within the upper portion 46 of the rotor to provide the support necessary for the pivoting of the centrifuge tubes 56 in the same manner as that presented in FIGS. 1 and 2. Similarly, the fluid medium 60 has its surface 62 reoriented approximately 90° from its position at rest shown in the right-hand portion of FIG. 3 to the position at operational speed as shown on the left-hand portion in FIG. 3.

The reorientation of the supporting fluid by approximately 90° during rotor acceleration and deceleration as well as the fact that the tube or container is immersed in the liquid at speed allows for the design of a swinging container type of rotor wherein the need for a very high strength material for the container and a high strength pivotal junction for the container are greatly minimized. Essentially, the net weight of the tube can be controlled depending upon the degree of immersion of the container within the supporting liquid and by varying the type of supporting liquid used with different densities or specific gravities.

Although particular embodiments have been shown and discussed, it is envisioned that the overall configuration of the rotor could be changed including the type of swinging container without departing from the scope of the present invention.

What is claimed is:

1. A centrifuge rotor comprising:

a rotor body portion having an internal chamber;

at least one fluid sample container pivotally mounted within said internal chamber of said rotor body portion, said container pivotal between a first position and a second position within said chamber; and liquid means within said internal chamber of said rotor body portion and in contact with said fluid sample container for providing buoyant support to said container when said container pivots between said first and second positions.

2. A centrifuge rotor as defined in claim 1, wherein the surface level of said liquid means moves between a first position and a second position in response to operation of said rotor.

3. A centrifuge rotor as defined in claim 1, wherein said container is at least partially immersed within said liquid means.

4. A centrifuge rotor comprising:

a rotor body having an internal chamber;

a plurality of fluid sample containers;

means for pivotally mounting said containers in said chamber, said pivotal mounting means providing partial support to said containers; and liquid means within said chamber for providing partial support to said containers.

5. A centrifuge rotor comprising:

a rotor body having an interior chamber;

a plurality of fluid sample containers pivotally mounted in said chamber, said containers swinging approximately 90° between an at-rest position and an at-speed position; and liquid means within said chamber for providing buoyant support to said containers while in said at-speed position.

6. A centrifuge rotor comprising:

a lower portion;

an upper portion connected to said lower portion forming an interior chamber;

a plurality of fluid sample containers pivotally mounted in said chamber, said containers moving between a first position and a second position; and liquid means in said chamber for providing support to said containers, the surface of said liquid means reorienting approximately 90° independent of said containers as said containers move between said first and second positions.

7. A centrifuge rotor comprising:

a rotor body portion;

a pivotal centrifuge tube;

at least two projections adjacent one end of said tube to pivotally connect said tube within said rotor body portion; and liquid means within said rotor body portion and in contact with said tube for providing bouyant support to said tube when said rotor is at operational speed.

* * * * *